United States Patent [19]

Pryor et al.

[11] Patent Number: 4,944,366

[45] Date of Patent: Jul. 31, 1990

[54] PNEUMATICALLY OPERATED SCAFFOLDING

[75] Inventors: Dewey L. Pryor; Charles L. Pryor, both of Reidsville, N.C.

[73] Assignee: D. L. Pryor & Sons, Inc., Reidsville, N.C.

[21] Appl. No.: 306,758

[22] Filed: Feb. 6, 1989

[51] Int. Cl.[5] ..... E04G 1/22

[52] U.S. Cl. ..... 182/141; 182/152; 182/63

[58] Field of Search ..... 182/141, 152, 149, 63, 182/178, 223, 151, 148; 248/188.2

[56] References Cited

U.S. PATENT DOCUMENTS

| | | | |
|---|---|---|---|
| 1,917,010 | 7/1933 | Bird | 182/148.4 |
| 2,177,153 | 10/1939 | Ross et al. | 182/152 X |
| 3,115,754 | 12/1963 | Joseph | 182/223 X |
| 3,221,838 | 12/1968 | Brayton | 182/141 |
| 3,504,642 | 4/1970 | Kovach | 182/223 X |
| 3,820,631 | 6/1974 | King et al. | 182/141 |
| 3,927,732 | 12/1975 | Ooka et al. | 182/152 X |
| 4,000,789 | 1/1977 | Zahner | 182/152 |
| 4,534,447 | 8/1985 | Champigny | 182/152 |
| 4,619,346 | 10/1986 | Deguerry | 182/141 X |

FOREIGN PATENT DOCUMENTS

| | | | |
|---|---|---|---|
| 91963 | 8/1968 | France | 182/152 |

*Primary Examiner*—Alvin C. Chin-Shue

[57] ABSTRACT

Pneumatic operated scaffolding is presented and includes a plurality of fluid operated cylinders to lift sheetrock or the like for ceiling joist attachment. The scaffolding includes a removable walk and adjustable legs for use in a variety of construction applications. Transverse braces having multiple joints, a removable work support frame, along with pivotable pneumatic cylinders allow the scaffolding to easily fold for compact storage and transportation purposes.

18 Claims, 2 Drawing Sheets

70
60
19a
23c
20a
21a
22a
15a
66a
14a
9a
11a
12a
12b
12c
12d
12e
13a
13b
10a
23d
19b
18b
6a
7a
4c
5a
26b
4d
18a
24a
8a
5b
24b
8b
6b
7b
61
1b
3
1a
2
17
16
65
48b
48a
20b
21b
23b
22b
23a
18c
6c
7c
8d
4b
24c
5c
5d
26a
4a
18d
7d
6d
8c
24d
66b
13c
11b
15b
9b
14b
13d
10b

PNEUMATICALLY OPERATED SCAFFOLDING

BACKGROUND OF THE INVENTION

1. Field Of The Invention

The invention herein relates to scaffolding and particularly pneumatic scaffolding which is used inside a building to lift sheetrock or other building materials such as ceiling panels to the ceiling joists for attachment thereto.

2. Description Of The Prior Art And Objectives Of The Invention

In the construction of houses and other buildings wherein standard 4'×8'×⅝" planar sheetrock panels are conventionally attached to the inside room studs for inner ceiling and wall surfaces which are finished (doped) and painted or papered. Since these panels are heavy and awkward to "hang", various devices have been used in the past to provide assistance and various kinds of scaffolding have been employed by workers to assist in handling sheetrock and other materials for attachment to ceiling joists. Certain types of pneumatic and other lift devices have heretofore been employed to help workers with such difficult tasks but due to the expense and inconvenience of automatic (pneumatic or electrical) scaffolding, such is not in widespread use. Thus, with the disadvantages and shortcomings known of scaffolding currently in use, the present invention was conceived and one of its objectives is to provide pneumatically operated scaffolding which is relatively easy to use by a single workman and is economical to purchase and use.

It is yet another objective of the present invention to provide pneumatically operated scaffolding which is relatively trouble free and can be set up, operated, dismantled and transported by a single workman.

It is still another objective of the present invention to provide pneumatically operated scaffolding which includes a plurality of air cylinders which will support a planer panel of sheetrock and which can be directed upwardly to the ceiling joists for attachment thereto.

It is still another objective of the present invention to provide pneumatically operated scaffolding which can be quickly disassembled and compactly stored and transported as required.

Various other objectives and advantages of the present invention will become apparent to those skilled in the art as a more detailed description of the invention is presented below.

SUMMARY OF THE INVENTION

Pneumatically operated scaffolding as presented includes a plurality of air cylinders for assisting workmen in attaching sheetrock panels or the like to ceiling joists inside rooms during construction of houses or other buildings. The device also includes a rectangular scaffold frame and a pair of transverse members which include foldable joints. Attached at each corner of the scaffold frame is a pneumatically operated cylinder. Also attached at each corner of the scaffold frame is a leg member for adjusting the height of the scaffold frame from the floor. Above the rectangular scaffold frame is a work support frame which may also be rectangular in shape for holding one or more pieces of sheetrock or other planer members. The pneumatically operated cylinders allow the work support frame to move upwardly to bring the sheetrock into contact with the ceiling joists where the sheetrock can then be nailed to the joists or otherwise attached. The scaffold frame includes a walk which may consist of a ¾ inch plywood base with a rubber mat or tread thereon. The scaffolding can be easily collapsed for storage or transportation purposes by removing the work support frame and rotating the pneumatic cylinders inwardly for substantially parallel alignment with the scaffold frame after removal of the walk. The leg members are then removed allowing the scaffold frame to be collapsed by bending the hingeable transverse brace members at each end of the scaffold frame for convenience in storage or transportation.

DESCRIPTION OF THE PREFERRED EMBODIMENT

Figure 1:
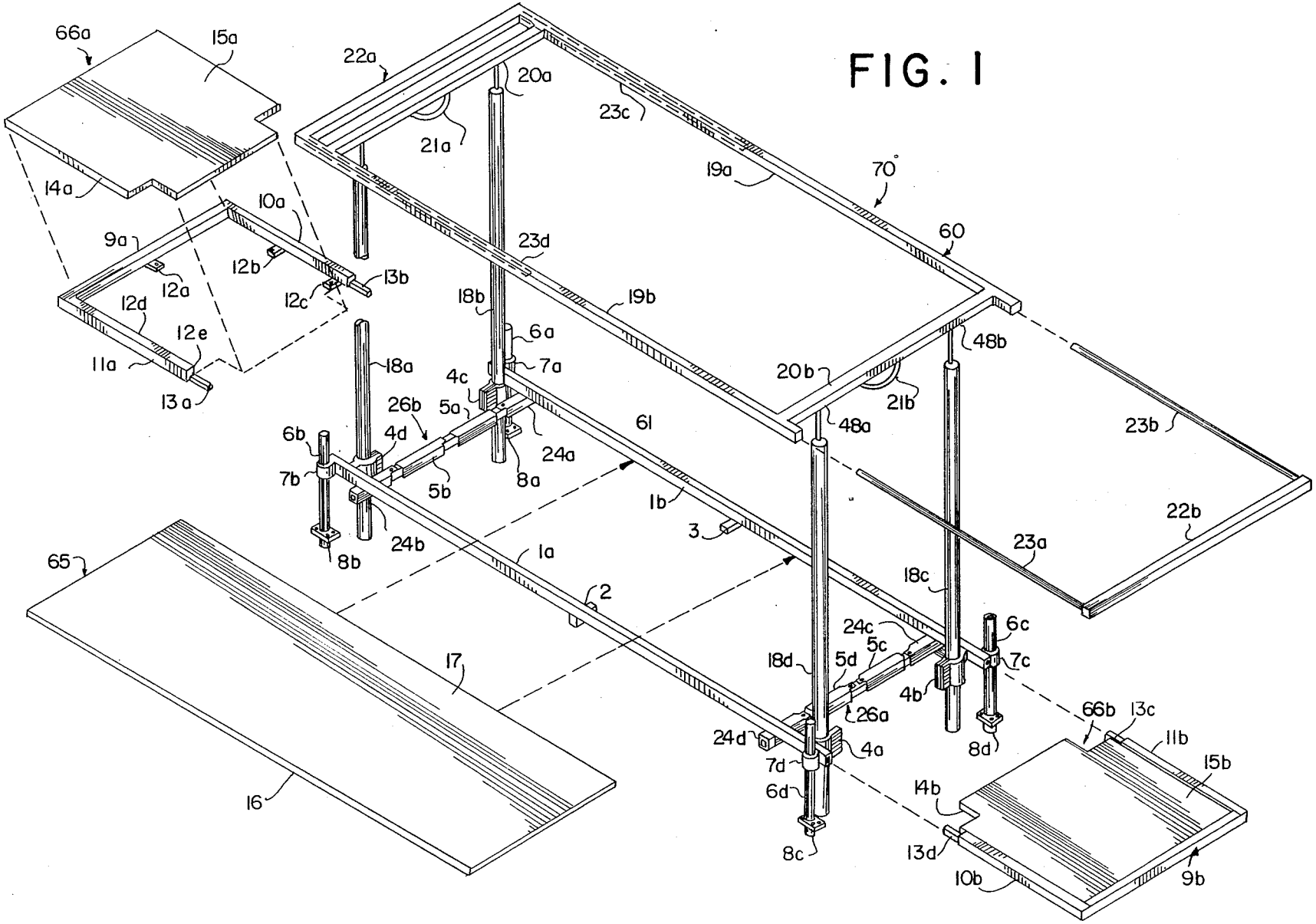
FIG. 1 illustrates the pneumatically operated scaffolding in a partially assembled perspective view.

The preferred form of the invention is shown in FIG. 1 whereby pneumatic operated scaffolding having a rectangular work support frame is attached at the corners to four pneumatic cylinders. The pneumatic cylinders are pivotally attached to a pair of tubular steel longitudinal frame members and also attached thereto are wheeled leg members. A pair of hingeable transverse braces are affixed at each end of the longitudinal frame members and the braces are foldable for storage purposes. A walk consisting of a ribbed rubber mat which is affixed to a plywood sheet is positionable between the transverse members and rest upon the extended transverse braces. A pair of frame extensions are located at each end of the scaffold frame to assist the workmen in reaching the ceiling joists as required. In the event longer (10 to 12 feet) sheetrock components are utilized, work support frame extensions are slidably received into the ends of the work support frame.

DETAILED DESCRIPTION OF THE DRAWINGS AND OPERATION OF THE INVENTION

Turning now to the drawings, for a more complete description of the invention and its method of operation, FIG. 1 demonstrates pneumatically operated scaffolding 70 which can be used by sheetrock hangers or other workmen to lift and support sheetrock or other materials during construction. As also seen in FIG. 1, scaffolding 70 includes an upper work support frame 60 which is rectangular in shape and is formed from tubular side members 19*a* and 19*b* which are joined to lateral end members 20*a* and 20*b*. Handles 21*a* and 21*b* can be manually used to override pneumatic cylinders 18*a, b, c* and *d* to adjust the placement of the sheetrock (not shown) or other materials against the ceiling joists. Lateral member 20*b* has handle 21*b* attached thereto and lateral member 20*a* has handle 21*a* attached to the underside thereof. Work frame extensions 22*a* and 22*b* as also seen in FIG. 1 can be withdrawn or extended as required to support long pieces of sheetrock or other paneling. Side members 19*a* and 19*b* may be for example five (5) feet in length whereas work frame extension members 23*a, b, c* and *d* may be for example two (2) feet in length to provide additional support to the work material being used.

Figure 7:
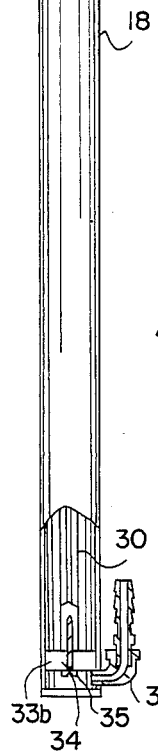
FIG. 7 features a cut-away pneumatic cylinder as used in the invention.
Figure 9:
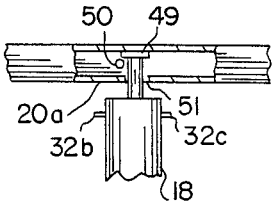
FIG. 9 illustrates a cut-away side view of the attachment of the pneumatically operated cylinder to the support frame.
Figure 10:
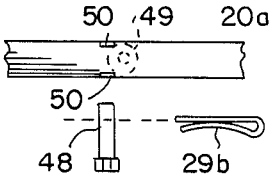
FIG. 10 demonstrates a top view of the attachment of the cylinder to the work support frame.

Pneumatic cylinders 18*a, b, c* and *d* are releasably attached to lateral members 20*a* and 20*b* shown in detail regarding member 20*a* in FIGS. 9 and 10. As illustrated therein, piston head 49 fits within opening 51 and is locked into place by pin 48 which passes through openings 50 on each side of lateral member 20*a*. Cotter pin 29*b* attaches to pin 48 to hold it in member 20*a*. As would be understood, pin 48 can be easily removed whereby support frame 60 can be separated from scaffolding 70. Pneumatic or air cylinders 18 as shown in FIG. 7 include inlet tube 36 so air under pressure can enter cylinder 18 and will apply upward force to slug 34 which is attached at the bottom of piston rod 30 thereby causing piston rod 30 to extend upwardly. O-ring 33*b* provides a seal between the inside cylinder wall of cylinder 18 and slug 34. As also seen in FIG. 7, upper slug pins 32*a, b* and *c* (in FIG. 9) maintain upper slug 31 in place and O-ring 33*a* provides a pneumatic seal thereto. Air is directed to pneumatic cylinders 18*a, b, c* and *d* as depicted in FIG. 1 by a conventional compressed air source such as a portable compressor (not shown) which is attached to manifold 2 as featured in FIG. 4 and air controls (not shown) as conventional would allow pneumatic cylinders 18*a, b, c* and *d* to be raised and lowered as needed. Fluid manifold 2 consists of a hollow tubular member with air inlet 37*b* attached thereto. Air which passes through fluid inlet 37*b* into manifold 2 exits stopcocks 38*a* and 38*b* as seen in FIG. 4 and stopcocks 38*a* and 38*b* are attached by hoses (not seen) each to "Y's" for connection to a pair of pneumatic cylinders 18*a, b, c* and *d*. Said hoses (not shown) are attached to fluid inlet tubes 36 as seen in FIG. 7 of each of said pneumatic cylinders.

Figure 2:
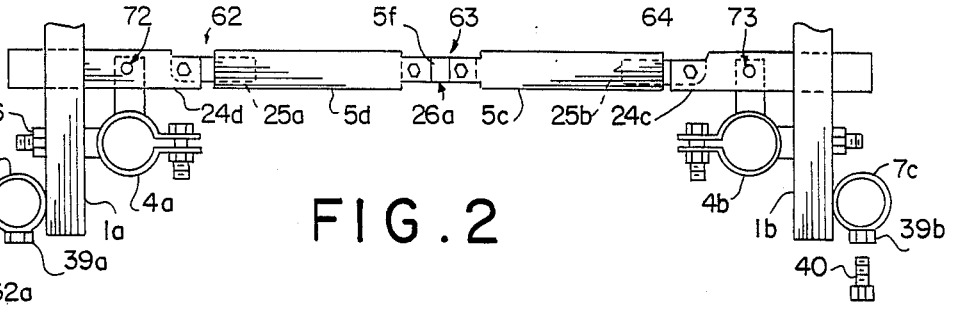
FIG. 2 demonstrates a top view of the hingeable transverse brace.
Figure 6A:
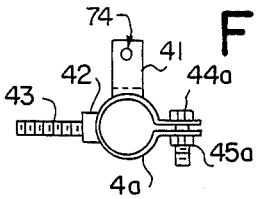
FIG. 6 depicts at **6*a* a plan view of the pivotal attaching mean.
FIG. 6*b* demonstrates a side view of said pivotal attaching means, and 6*c*** an end view of the attaching means.
Figures 6B, 6C:
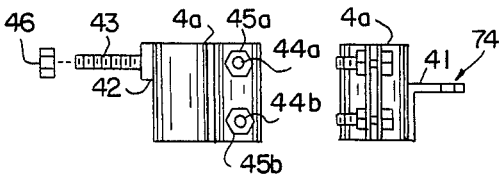
Figure 8:
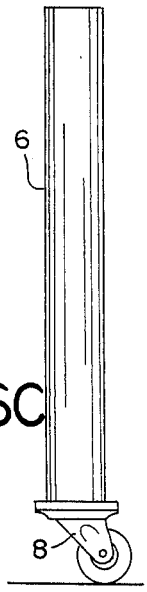
FIG. 8 shows a leg member with a caster affixed thereto.

In order to compactly store scaffolding 70, pneumatic cylinders 18 are rotatably attached to longitudinal frame members 1*a* and 1*b* as pictured in FIGS. 1 and 2. As seen in FIG. 2, pivotable cylinder attaching means 4*a* and 4*b* consists of a c-clamp configuration. In FIG. 6 pivotable attaching means 4*a* includes a threaded member 43 which passes through longitudinal member 1*a* as shown in FIG. 2 and is tightened thereon by nut 46. Stop bar 41 as shown in FIG. 2 is positioned under hingeable transverse brace 26*a*. A locking pin (not shown) can be passed through openings 72 and 73 in transverse brace 26 as shown in FIG. 2 and through stop bar opening 74 as depicted in FIG. 6. Thus, with nut 46 loosened, cylinder 18*b* as shown in FIG. 1 fitted within pivotal attaching means 4*a* can be rotated inwardly (after removal of work support frame 60 and with removal of scaffold walk 65) for storage purposes. As further seen in FIG. 6, pneumatic cylinder 18*a* is tightened by bolts 44*a* and *b* into nuts 45*a* and 45*b* of attaching means 4*a*. Shoulder 42 provides a flat contact surface for abutment with longitudinal member 1*a*. Scaffold leg members 6*a, b, c* and *d* shown generally at FIG. 8 comprise a cylindrical tube 6 having a caster 8 attached thereto. Members 6*a, b, c* and *d* can be adjusted to various heights by the use of leg clamps 39*a, b, c* and *d* as shown in FIGS. 1 and 2. Leg clamp bolt 40 as shown in FIG. 2 are received by clamp nuts 39*a, b, c* and *d* respectively whereby scaffolding 70 can thus be raised and lowered as desired. In order to collapse scaffolding 70 as shown in FIG. 1, scaffold leg members 6*a, b, c* and *d* may be removed from leg clamps 7*a, b, c* and *d* and walk 65 is removed from scaffold frame 61. Scaffold frame extensions 9*a* and 9*b* (if in place) are removed along with extension walks 15*a* and 15*b* respectively. Next, work support frame extensions 22*a* and 22*b* are pushed inwardly as shown by 22*a* in FIG. 1 and work support frame 60 is removed from pneumatic cylinders 18*a, b, c* and *d* by removing pins 48 as shown in FIG. 10. Pneumatic cylinders 18*a, b, c* and *d* are then pivoted inwardly with pivotable attaching means 4*a, b, c* and *d* which turns about threaded members 43 in longitudinal members 1*a* and *b* as shown in FIGS. 2 and 6. Transverse braces 26 shown in FIGS. 2 and 3 can then be folded inwardly at joints 62, 63 and 64. Thus, a compact and easily transportable scaffolding is povided with a minimum number of separate components.

Figure 4A:
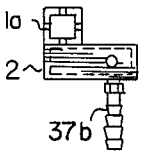
FIG. 4 pictures at **4*a* a side elevational view of the pneumatic manifold and 4*b*** demonstrates a view of the pneumatic manifold with stopcocks attached.
Figure 4B:
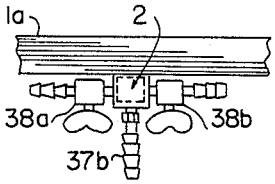

Scaffold walk 65 as shown in FIG. 1 is positioned on top of hingeable transverse braces 26*a* and *b* and walk 65 rests upon walk support 3 and on top of fluid manifold 2 as shown in FIG. 4*a*. Walk 65 is formed from a $\frac{3}{4}$ inch plywood base 16 and includes a non-slip rubbed rubber tread or mat 17. Scaffold frame extensions 9*a* and 9*b* likewise include extension walks 66*a* and *b* which fit within frames 9*a* and 9*b* respectively. As seen in FIG. 1 frame extensions 9*a* and 9*b* are composed of parallel side members 10*a* and 11*a* and include a series of walk supports 12*a, b, c, d* and *e* as seen in FIG. 1.

Figure 3:
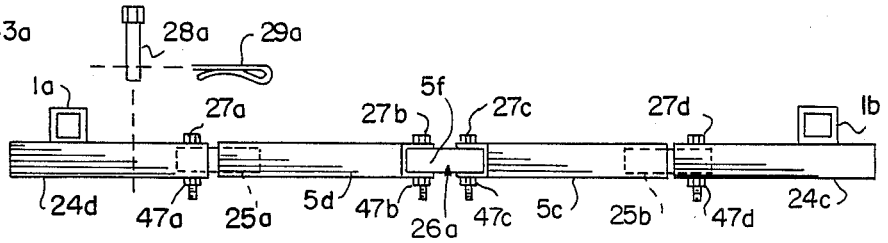
FIG. 3 shows side elevational view of the hingeable transverse base.
Figure 5:
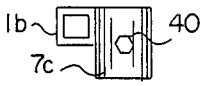
FIG. 5 demonstrates a side view of the scaffold leg clamps.

For a better understanding of the operation and folding of hingeable transverse brace members 26*a* and 26*b*, as seen in FIG. 2, brace member 26*a* comprises components 24*c* and *d* which are tubular steel members welded to longitudinal members 1*b* and 1*a* respectively. Brace components 5*c* and 5*d* are hingeably attached to each other through member 5*f* to form joint 63 and member 5*c* is hingeably joined to member 24*c* whereas member 5*d* is hingeably joined to member 24*d* to form joints 62 and 64. Components 24*a, b, c* and *d* utilizing brace bolts 27*a, b, c* and *d* respectively are received by bolt nuts 47*a, b, c* and *d* as shown in FIG. 3. As may be understood, member 25*a* is rigidly joined (welded) to component 5*d* and member 25*b* is likewise welded inside to brace component 5*c*. The trio of hingeable joints 62, 63 and 64 thereby provide an easily collapsible transverse brace 26*a*, yet one that is strong and rigid while extended during use of scaffolding 70.

Various modifications and changes can be made to the invention by those skilled in the art and the illustrations and examples presented herein are not intended to limit the scope of the appended claims.

We claim:

1. Pneumatic operated scaffolding comprising a work support frame, a pneumatic cylinder, said cylinder attached to said support frame, a scaffold frame, means to pivotally attach said cylinder to said scaffold frame means to stop rotation of said cylinder, said stop means joined to said attaching means whereby said cylinder will lift said work support frame during use and after use said cylinder can be detached from said work support frame and rotated by said attaching means into a storage configuration wherein said attaching means comprises a c-clamp, a threaded member, said stop means consisting of a stop bar, said threaded member and said stop bar attached to said c-clamp, said c-clamp for engaging said cylinder and said threaded member for attachment to said scaffold frame.

2. Pneumatic operated scaffolding as claimed in claim 1 wherein said work support frame is rectangular.

3. Pneumatic operated scaffolding as claimed in claim 2 wherein said work support frame includes a handle.

4. Pneumatic operated scaffolding as claimed in claim 1 and including a support frame extension, said support frame extension releasably attached to said work support frame.

5. Pneumatic operated scaffolding as claimed in claim 1 and including a leg, said leg adjustably affixed to said scaffold frame.

6. Pneumatic operated scaffolding as claimed in claim 5 and including a leg clamp, said leg clamp attached to said scaffold frame for adjustably receiving said leg.

7. Pneumatic operated scaffolding as claimed in claim 1 and including a fluid manifold, said manifold communicating with said pneumatic cylinder.

8. Pneumatic operated scaffolding as claimed in claim 1 wherein said scaffold frame includes a hingeable transverse brace.

9. Pneumatic operated scaffolding as claimed in claim 1 wherein said scaffold frame comprises a rectangular configuration.

10. Pneumatic operated scaffolding as claimed in claim 1 wherein scaffold frame includes a pair of longitudinal members, a pair of transverse braces, each of said transverse braces attached to said longitudinal members.

11. Pneumatic operated scaffolding as claimed in claim 8 wherein said transverse brace includes a hingeable joint.

12. Pneumatic operated scaffolding as claimed in claim 8 wherein said transverse brace includes a trio of hingeable joints.

13. Pneumatic operated scaffolding as claimed in claim 1 and including a scaffold frame extension, said extension for attachment to said scaffold frame.

14. Pneumatic operated scaffolding as claimed in claim 1 and including a walk, said walk positioned on said scaffold frame.

15. Pneumatic operated scaffolding as claimed in claim 13 and including an extension walk, said extension walk positioned on said scaffold frame extension.

16. Pneumatic operated scaffolding comprising:

a rectangular scaffold frame, a plurality of pneumatic cylinders, one of said plurality of cylinders positioned at each corner of said frame, means to pivotally attach said cylinder to said scaffold frame, means to stop rotation of said cylinder, said stop means joined to said attaching means a work support frame, said work support frame releasably attached to said pneumatic cylinder above said scaffold frame, a walk, said walk positioned on said scaffold frame, said scaffold frame including a pair of hingeable transverse members, whereby with said work support frame removed from said cylinders, said cylinders will pivot on said attaching means inwardly of said scaffold frame and said transverse member can collapse for compact scaffolding storage wherein said attaching means comprises a c-clamp, a threaded member, said stop means consisting of a stop bar, said threaded member and said stop bar attached to said c-clamp, said c-clamp for engaging said cylinder and said threaded member for attachment to said scaffold frame.

17. Pneumatic operated scaffolding as claimed in claim 16 and including adjustable legs, said legs attached to said scaffold frame.

18. Scaffolding comprising: a work support frame, a cylinder member, said cylinder member releasably attached to said support frame, a scaffold frame, means to pivotally attach said cylinder member to said scaffold frame, means to stop rotation of said cylinder, said stop means joined to said attaching means whereby said cylinder member can be rotated into a storage configuration when not in use wherein said attaching means comprises a c-clamp, a threaded member, said stop means consisting of a stop bar, said threaded member and said stop bar attached to said c-clamp, said c-clamp for engaging said cylinder and said threaded member for attachment to said scaffold frame.

* * * * *